US005716282A

United States Patent [19]

Ring et al.

[11] Patent Number: 5,716,282

[45] Date of Patent: Feb. 10, 1998

[54] SPINNING WATER RIDE APPARATUS AND METHOD

[75] Inventors: Oliver Alan Ring, Houston, Tex.; Douglas John Heke, Langley, Canada

[73] Assignees: Bay Boats, Inc., Kyle, Tex.; White Water West Industries, Ltd., British Columbia, Canada

[21] Appl. No.: 677,611

[22] Filed: Jul. 8, 1996

[51] Int. Cl.[6] ..... A63G 21/18

[52] U.S. Cl. ..... 472/117; 472/128; 104/70

[58] Field of Search ..... 472/88, 117, 128, 472/129; 104/70, 73, 59

[56] References Cited

U.S. PATENT DOCUMENTS

| | | | |
|---|---|---|---|
| 1,607,771 | 11/1926 | Miller | 104/70 X |
| 3,830,161 | 8/1974 | Bacon | 104/70 |
| 4,149,710 | 4/1979 | Rouchard | 272/56.5 |
| 4,836,521 | 6/1989 | Barber | 272/32 |
| 4,984,783 | 1/1991 | Fujimaki | 272/565 |
| 5,069,443 | 12/1991 | Shiratori | 272/56.5 |

*Primary Examiner*—Kien T. Nguyen

*Attorney, Agent, or Firm*—Shaffer & Culbertson; Russell D. Culbertson

[57] ABSTRACT

A water ride includes a flume (10) defining a ride path. Patrons of the ride travel in rafts (24) along the flume (10) with the rafts riding on a thin layer of water introduced into the flume. To induce the rafts (24) to spin at desired locations in a controlled fashion, the rafts each include raft features (30) located on a bottom surface (32) of the raft. Flume features (34) are positioned at desired locations along the ride path in position to make contact with the raft features (30). This contact between the raft features (30) and the flume features (34) induces a controlled spin to the raft (24). The raft features (30) preferably include projections (36) extending downwardly from the bottom surface (32) of the raft at locations offset from a raft center of rotation. The flume features (34) preferably comprise alternating depressions (38) and ridges (40) extending transversely to the ride path along one side of the flume (10).

17 Claims, 3 Drawing Sheets

SPINNING WATER RIDE APPARATUS AND METHOD

BACKGROUND OF THE INVENTION

This invention relates to a water ride in which patrons travel in a raft along a flume, and more particularly, to a water ride with an arrangement for causing the raft to spin as it travels along the flume. The invention also includes a method for inducing spin in a water ride.

Many types of amusement park water rides have become popular in recent years. In one type of water ride, patrons sit in a generally circular raft and the raft travels along a circuitous course defined by a flume. The flume slopes downwardly and includes various bends and turns, with water running along the bottom of the flume.

One major problem with these types of water rides is that they can become monotonous when used over a period of time. The flume course is fixed and cannot be changed readily to provide any different sensations to patrons using the ride. The rafts travel generally along the same path each ride.

Another problem is that the rafts tend to stay in the same orientation for each ride. Thus, the rafts tend to rub up against the flume surfaces over and over again at the same points, producing an uneven wear pattern on the raft's outer surfaces. This uneven wear can require frequent reparations.

U.S. Pat. Nos. 4,984,783 and 5,069,443 both show water rides with a structure intended to induce a spin to the raft as it travels along the flume. In U.S. Pat. No. 4,984,783 the spin is intended to be induced by contact between the side of the raft and a substantially vertical wall of the flume. However, this method of attempting to induce a spin to the raft required hard bumping or contact between the raft and the flume wall and this hard bumping posed a safety risk to patrons riding in the raft.

U.S. Pat. No. 5,069,443 discloses a ride which includes a flume with a sloped surface or a step or ridge extending longitudinally along one side of the flume. The longitudinally extending features were intended to induce spin to the raft when one side of the raft rode up over the particular feature.

There were several problems with the water park ride structure shown in U.S. Pat. No. 5,069,443. One problem was that the structure did not consistently and effectively induce a spin to the raft. Another problem was that the structure was integrally formed with the flume and could not be changed. Thus, the ride remained generally the same time after time.

SUMMARY OF THE INVENTION

It is an object of the invention to provide a water ride which overcomes the above-described problems and others associated with prior water rides. More particularly, it is an object of the invention to provide a water ride which induces a spin to the raft at desired points along the ride path. These spin inducing points may preferably be changed from time to time to provide a new ride sensation to patrons while using the same general flume structure.

To accomplish this object, a raft for the water ride includes raft features on the bottom surface of the raft, and the flume includes flume features at one or more points along the ride path which the flume follows. Contact between the raft features and the flume features as the raft travels along the flume causes the raft to spin in a controlled fashion. Although the raft and flume features may be integrally formed with the raft and flume, respectively, such features are preferably separately formed and then attached to the raft or flume by suitable means. The separately formed raft and flume features allow prior art water rides to be retrofitted to provide a spinning water ride according to the invention. Also, the separately formed flume feature may be repositioned in the flume each season, or more frequently, to provide a different spinning action with the same general flume structure.

As with prior water park rides, the ride according to the invention includes a flume which follows a ride path, and has a layer of water running along a bottom flume surface. The raft used in the invention may be any suitable shape, but is preferably circular with a generally flat bottom surface.

The preferred raft feature includes a plurality of projections extending from the bottom surface of the raft. The projections are located at various points along the periphery of the raft or other area that is offset from the center of the raft. The projections are preferably mounted on a base of material which is itself adhered by suitable means to the raft bottom surface. The flume feature includes a ridge or series of ridges extending transversely to the ride path along one side of the flume. In the preferred form of the invention, the ridges comprise the edges of depressions formed in a depression base which is attached to the flume bottom surface.

As the raft according to the invention travels along the ride path down the flume, the peripherally mounted projections on the raft bottom contact the ridges on the flume bottom surface. The side of the raft along which the contact is made slows with respect to the opposite side of the raft, thus, inducing a spin about the center of the raft.

These and other objects, advantages, and features of the invention will be apparent from the following description of the preferred embodiments, considered along with the accompanying drawings.

DESCRIPTION OF THE PREFERRED EMBODIMENTS

Figure 1:
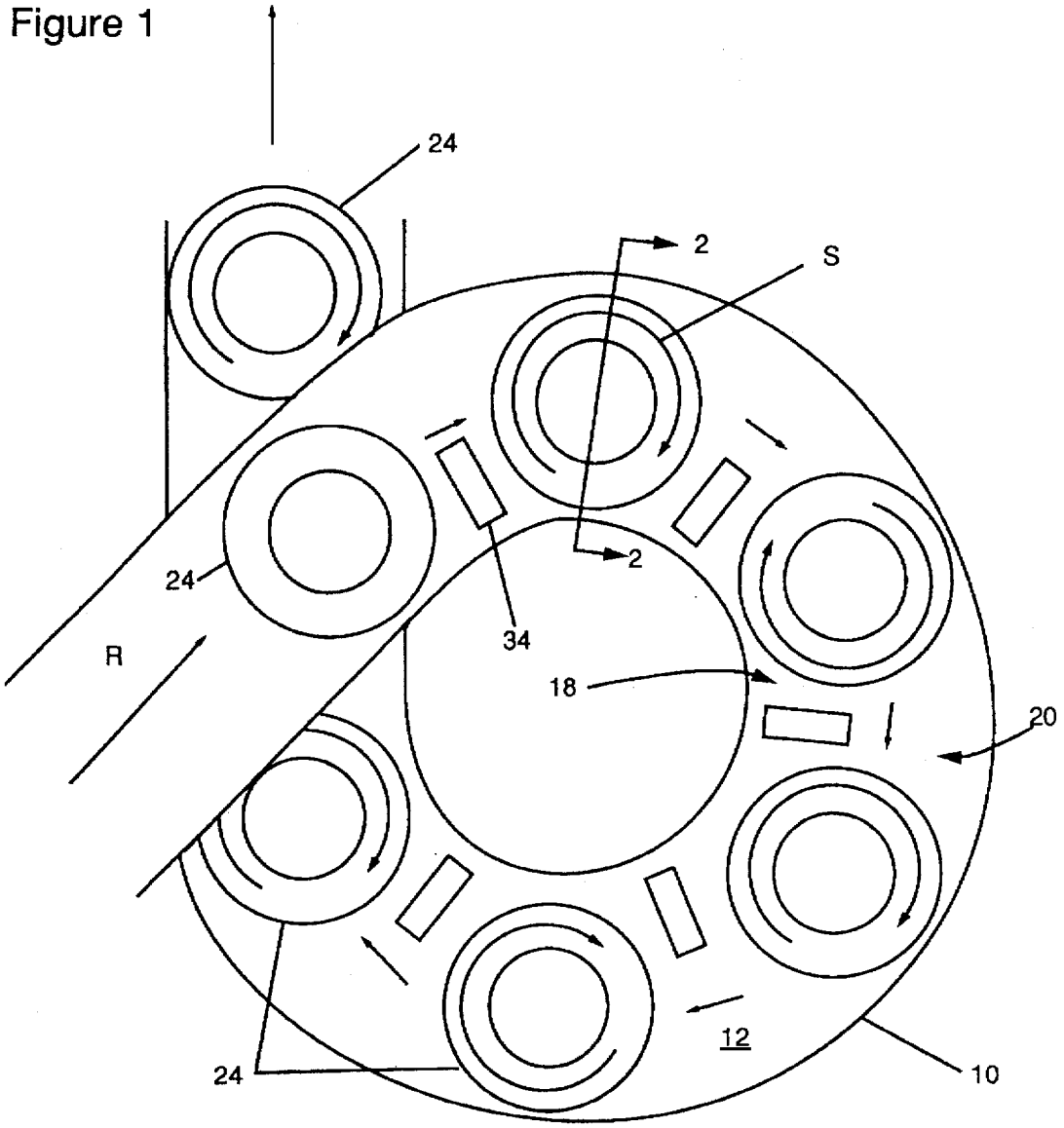
FIG. 1 is a somewhat diagrammatic top plan view of a raft and a portion of a water ride apparatus embodying the principles of the invention.
Figure 2:
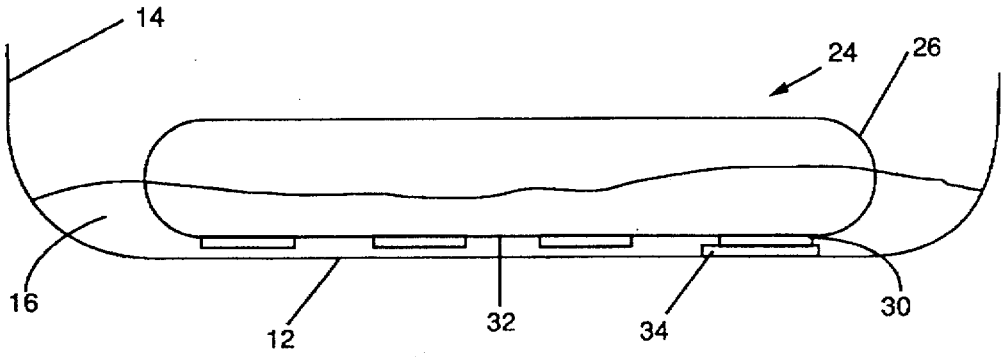
FIG. 2 is a view in transverse section taken along line 2—2 in FIG. 1.

FIGS. 1 and 2 illustrate a water ride embodying the principles of the invention. The water ride includes a flume 10 which extends preferably along a circuitous course to define a ride path. As shown best in FIG. 2, the flume 10 includes a bottom surface 12 and sidewalls 14. Although not shown in the figures, the ride also includes means for introducing a thin layer of water 16 to the flume so that the water travels swiftly along the bottom surface thereof in a ride direction indicated at arrow R. The flume 10 preferably includes one or more bends or curves, each bend or curve having an inside section 18 and an outside section 20.

The flume 10 may be constructed of a plurality of sections (not shown) connected end to end to make the desired ride path with straight sections and curves. In one form of the invention, the individual flume sections may be made from fiberglass and connected together by flanges formed on the fiberglass sections.

The ride also includes a raft 24 in which patrons may be seated during the course of the ride. The preferred raft 24 is circular in shape although other raft shapes may be employed according to the invention. Also, the preferred raft 24 is made of one or more inflatable rings 26 which form the sides of the raft, with a layer of material connected to the bottom ring and forming the floor of the raft. Although inflatable rafts are preferred for their durability and relatively low cost, other types of rafts may be used according to the invention.

Commonly, the ride begins at an elevated section of the flume (elevated section not shown) where patrons enter a raft 24 and the raft may be released into the flume 10. Water injected into the flume 10 flows along the bottom 12 of the flume down the incline from the elevated beginning point to a bottom pool (not shown) where the water collects for recirculation to the top of the flume. The flume 10 may also include uphill sections in which water is pumped uphill to propel the raft in the desired direction. The rafts 24 exit the flume 10 into the pool and eventually travel to an unloading area (not shown) where patrons disembark from the raft. The rafts 24 are then loaded on a suitable conveyor system (not shown) or other device and are lifted again to the starting position for loading and another run through the ride.

Figure 3:
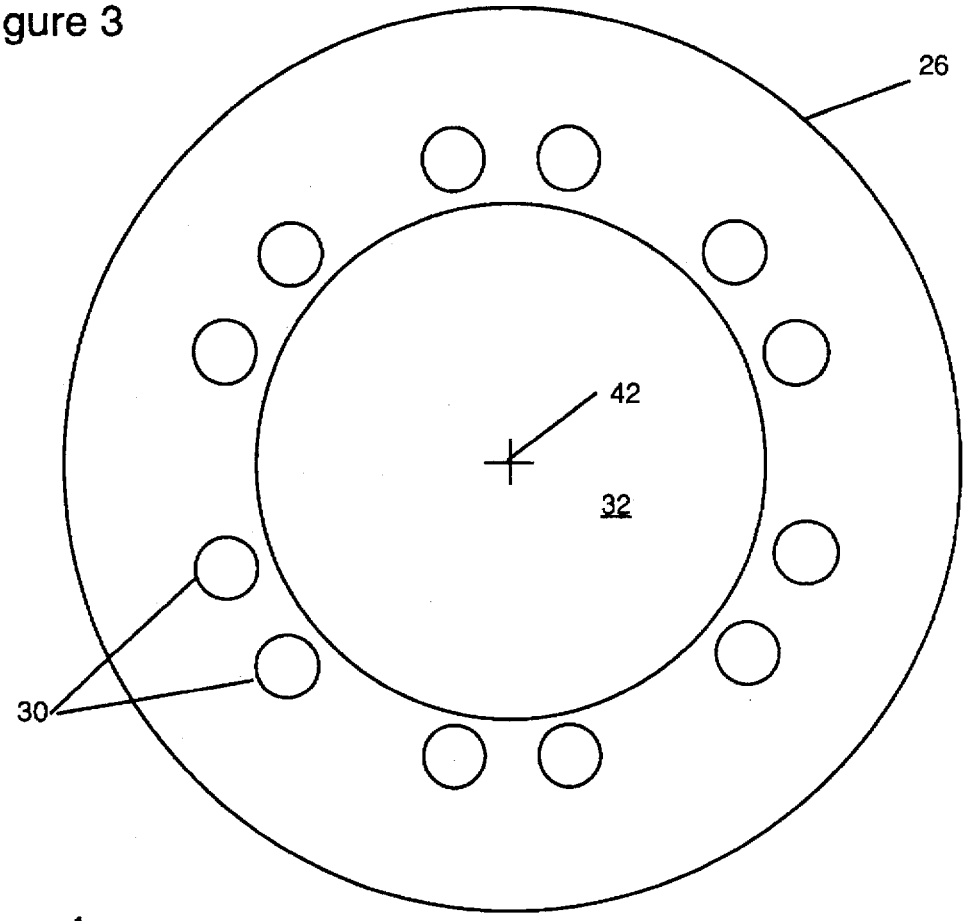
FIG. 3 is a bottom plan view of the raft for the water ride.
Figure 4:
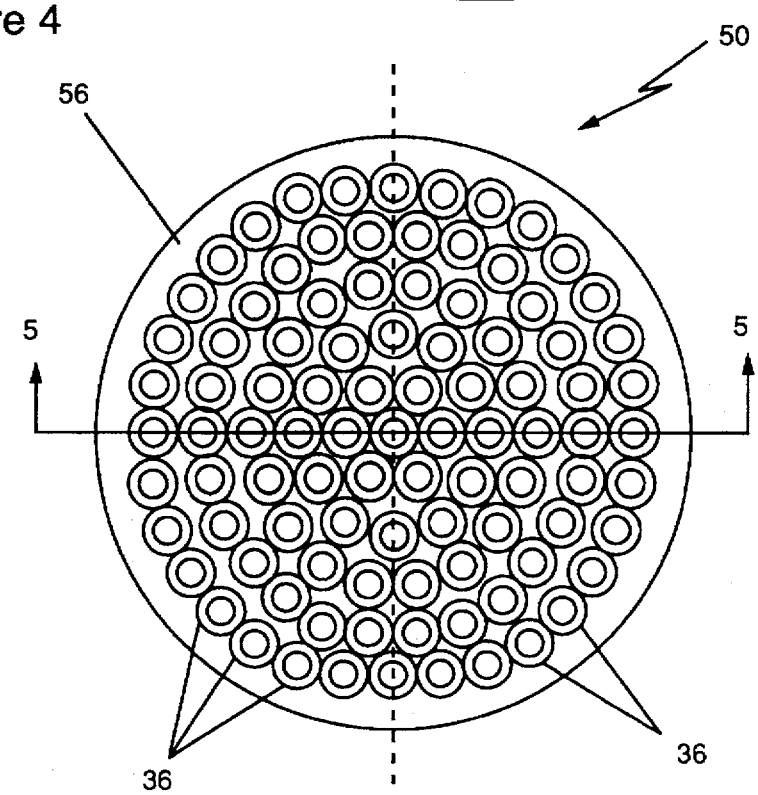
FIG. 4 is a top plan view of a raft attachment according to the invention.
Figure 5:
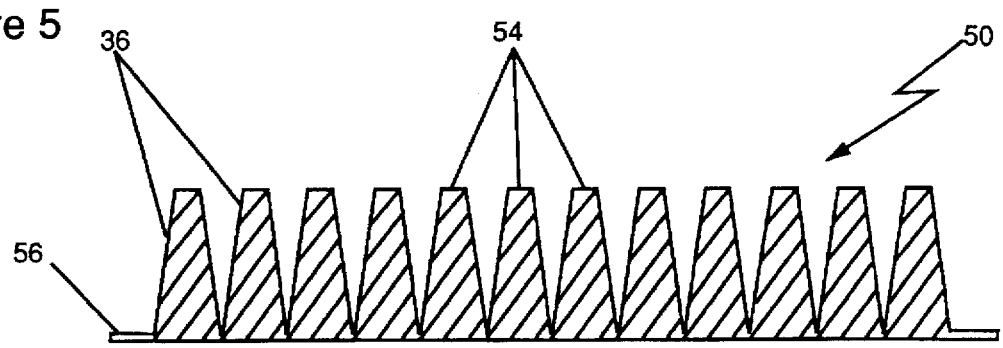
FIG. 5 is a view in section taken along line 5—5 in FIG. 4.
Figure 6:
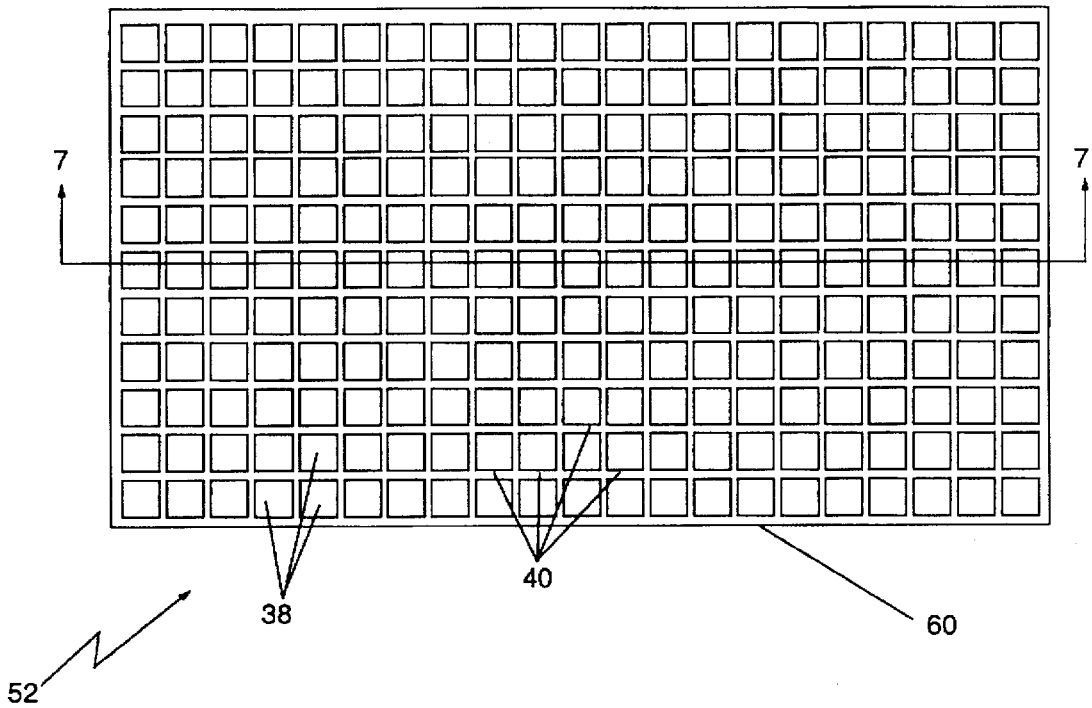
FIG. 6 is a top plan view of a flume attachment according to the invention.
Figure 7:
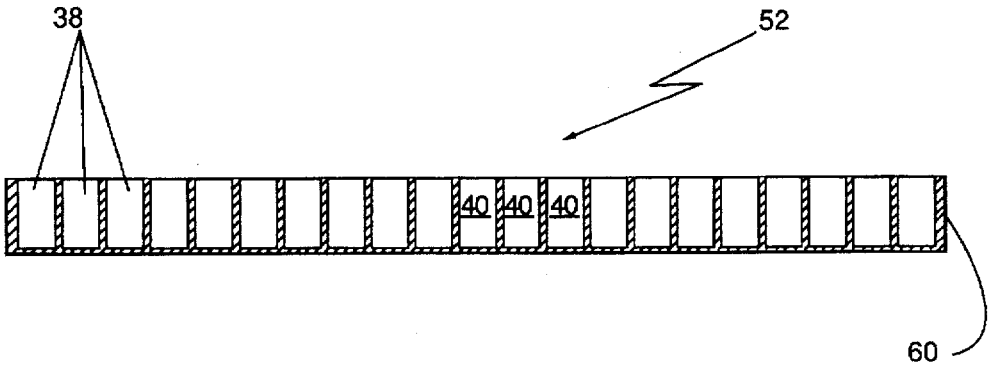
FIG. 7 is a view in section taken along line 7—7 in FIG. 6.

Referring to FIGS. 1 through 7, the invention includes at least one raft feature 30 located on a bottom surface 32 of the raft 24, and at least one flume feature 34 located on the bottom surface 12 of the flume 10. In the preferred form of the invention the raft feature 30 includes a plurality of projections 36 (FIGS. 4 and 5) while the flume feature includes a plurality of depressions 38 formed between ridges 40 (FIGS. 6 and 7). Contact between the projections 36 on the raft 24 and ridges 40 on the flume 10 as the raft travels along the ride path causes one side of the raft to slow with respect to the opposite side of the raft, thus causing the raft to spin about its center of rotation or spin axis 42. As shown in FIG. 3, the center of rotation 42 of the circular raft 24 coincides generally with the center axis of the circular shape.

The projections 36 on the raft bottom surface 32 are located in projection areas offset from the center of the raft bottom surface. Although there may be only one set of projections according to the invention, the preferred form of the invention shown in FIG. 3 includes a plurality of projection areas spaced apart about a periphery of the raft bottom surface 32 in a generally circular pattern.

Each flume feature 34 extends across one side of the flume 10 transversely to the ride path in that area. The preferred form of the invention includes several flume features 34 located along the flume at different locations to induce spinning, help to continue a spin, or even stop a spin when desired. When it is desired to start a spin, the spin is best induced along the curved portion of the flume, with the flume features being located at an inside portion 18 of the curve as shown in FIG. 1.

Although the raft features 30 and flume features 34 may be formed integrally with the raft 24 and flume 10, respectively, the preferred form of the invention includes separately formed raft attachments 50 and flume attachments 52 which are connected in position in a suitable manner. FIGS. 4 and 5 show a preferred raft attachment 50 having the desired projections 36 while FIGS. 6 and 7 show the preferred flume attachment 52 in which the desired depressions 38 and ridges 40 are formed.

Referring to FIGS. 4 and 5, regardless of whether the projections 36 are integrally formed or otherwise, the projections are preferably frustoconical in shape. The smaller diameter end 54 of the frustoconical shape extends away from the bottom surface of the raft. When formed separately from the raft, the projections 36 are connected to a base 56. Although a circular base 56 is shown, the base may be any suitable shape for connecting in some manner to the bottom surface 32 of the raft 24. In the preferred form of the invention, the projections 36 are molded together with the base 56 in a unitary piece of material. The base 56 and projections 36 may be made from urethane or neoprene rubber or any other suitable material providing sufficient rigidity, but allowing elastic deformation in the projections as they contact the flume features. Also, the projections are preferably approximately 0.75 inches in length, 0.5 inches in diameter at the base 56, and 0.25 inches in diameter at the smaller diameter end 54.

Referring to FIGS. 6 and 7, the flume attachment 52 includes a base material 60 in which a plurality of the depressions 38 are formed. The depressions 38 preferably form a checkerboard pattern with each depression having a rectangular cross-sectional shape and a rectangular profile. The depressions are preferably 0.75 inches deep and 1.0 inch wide. The material between the depressions 38 form ridges 40 with an edge at the top thereof. Whether formed on an attachment or integrally with the flume, the ridges 40 extend transverse to the ride path along which the raft 24 travels along the flume. This transverse positioning provides good contact with the projections 36 on the raft to produce the desired slowing at one point of the raft, offset from the raft's center of rotation 42. As with the raft attachment 50, the flume attachment 52 is preferably molded in one piece from a suitable material such as neoprene rubber. Each flume attachment 52 may be attached in any suitable fashion to the flume bottom surface 12, such as by screws (not shown) which extend into the flume material.

The operation and method of the invention may now be described with particular reference to FIGS. 1 and 2. As the raft 24 travels along the ride path through the flume 10 in the ride direction R, the raft features 30 make contact with the flume features 34 as the raft passes. The contact between the preferred raft features 30 and flume features 34 causes the raft to slow at the point at which contact is made. Since the raft features 30 are offset from the to center of the raft 24, and the flume features 34 extend only along one side of the flume, the contact between the raft feature 30 and flume feature 34 is always offset from the raft's center of rotation 42. Thus, the contact applies a force to the raft that is offset from the raft's center of rotation. This causes the side of the raft 24 opposite the side on which contact is made to travel at a somewhat higher speed than the side upon which the contact is made, and the raft therefore spins in the direction shown by arrow S in FIG. 1. The spin is counter-clockwise when the contact between raft feature 30 and flume feature 34 is on the left side of the raft traveling along the ride direction, and clockwise when the contact is on the right side of the raft. Multiple flume features may be included to produce a complete 360 degree spin about the raft center of rotation 42 whereas a single flume feature in a certain area may produce a partial spin.

The spin in the raft 24 according to the invention is made without substantial bumping between the wall 14 of the flume 10 and the raft. Also, since the flume features 34 and raft features 30 need not be formed integrally with the raft and flume, these features may be added to existing rides to make a spinning water ride according to the invention. Furthermore, a non-integrally formed flume feature 34, such as the flume attachment 52 shown in FIGS. 6 and 7, may be switched from position to position along the flame 10. The flume features 34 in different positions will cause the rafts 24 to spin differently, producing different sensations to the patrons and helping to prevent the ride from becoming monotonous over time.

The above described preferred embodiments are intended to illustrate the principles of the invention, but not to limit the scope of the invention. Various other embodiments and modifications to these preferred embodiments may be made by those skilled in the art without departing from the scope of the following claim. For example, although the raft feature projections 36 are illustrated as being frustoconical in shape, the projections may be any shape that can catch on the flume features as the raft travels along the flume 10. Also, the flume features 34 may comprise substantially any features which provide good contact with the raft features to produce the desired slowing in the raft at the contact point. The flume features may extend substantially across the entire width of the flume to help slow the raft down, or across either side of the flume on either the inside or outside of a curve or in a straight section to cause the raft to spin. Furthermore, the raft bottom surface may comprise a high friction material such as Neoprene tubber, Urethane rubber, or a mixture of the two and this material may cause sufficient friction when it contacts the flume features to cause the raft to spin or slow without the use of raft features which project downwardly from the raft bottom surface.

We claim:

1. A water ride apparatus comprising:

(a) a flume which defines a ride path, and including water input means associated with the flume for directing a layer of water along a bottom surface of the flume in a ride direction;

(b) a raft adapted to slide through the flume and along the ride path in the ride direction on the layer of water;

(c) a plurality of projection areas, the plurality of projection areas being spaced apart around a periphery of the raft bottom surface, each projection area including a plurality of projections extending downwardly away from the bottom surface of the raft; and (d) a ridge area located on the bottom surface of the flume, the ridge area extending transversely to the ride path across a portion thereof and including a plurality of upwardly opening depressions, each depression including a depression edge facing substantially transversely to the ride path in position to contact a projection in one of the projection areas as the raft travels along the ride path in the ride direction, said contact causing the raft to spin about a raft center of rotation.

2. The apparatus of claim 1 wherein:

(a) each projection area comprises a projection base connected to the bottom surface of the raft and the projections in each projection area extend from the projection base in that area; and (b) each ridge area comprises a ridge base connected to the bottom surface of the flume and the depressions are formed in the ridge base.

3. The apparatus of claim 1:

(a) wherein the ride path follows a curve; and (b) the ridge area extends across an inside portion of the curve.

4. The apparatus of claim 1 wherein the projections are approximately 0.75 inches in length.

5. The apparatus of claim 1 wherein the projections have a frustoconical shape with a smaller diameter end extending away from the raft bottom surface.

6. The apparatus of claim 1 wherein the depressions located on the flume bottom surface have a substantially rectangular cross sectional shape and a substantially rectangular profile.

7. The apparatus of claim 1 wherein the depressions located on the flume bottom surface are approximately 0.75 inches deep, and the depression edge is approximately 1.0 inch.

8. In a water ride of the type in which a raft travels along a ride path through a flume on a layer of water running along a bottom surface of the flume, the improvement comprising:

(a) at least one raft feature located on a bottom surface of the raft at a position spaced apart from a raft center of rotation, each raft feature including a raised edge positioned along a line extending generally radially from the raft center of rotation; and (b) at least one flume feature located on the flume bottom surface, in position to contact the raft feature as the raft travels along the ride path, wherein the contact between the raft feature on the raft bottom surface and the flume feature on the flume bottom surface induces the raft to spin about the raft center of rotation.

9. The apparatus of claim 8 wherein:

(a) each raft feature comprises a projection area having a plurality of projections extending from the bottom surface of the raft and located at a peripheral area of the raft bottom surface; and (b) each flume feature comprises a plurality of upwardly opening depressions in a ridge area extending transversely to the ride path across a portion of the ride path, each depression having associated with it an edge at a top end of the depression.

10. The apparatus of claim 9 wherein the raft includes a plurality of projection areas on the raft bottom surface, the plurality of projection areas each being positioned at a different peripheral area of the raft bottom surface so as to form a substantially circular pattern.

11. The apparatus of claim 9 wherein the ride path includes a curve and wherein the ridge area extends transversely to the ride path across an inside portion of the curve.

12. The apparatus of claim 9 wherein the projections are connected to a base formed separately from the raft bottom and the base is secured to the raft bottom surface.

13. The apparatus of claim 9 wherein the depressions are formed in a base secured to the bottom surface of the flume.

14. The apparatus of claim 9 wherein each projection is approximately 0.75 inches in length and each depression is approximately 0.75 inches deep.

15. The apparatus of claim 9 wherein the projections are frustoconical with a smaller end extending away from the raft bottom surface.

16. In a water ride in which a raft travels on a layer of water along a ride path through a flume, and in which the raft includes at least one raft feature located on a bottom surface of the raft and offset from a center of rotation of the raft, the method comprising the steps of:

(a) aligning at least one raft feature so that it provides a raised edge extending generally transverse to the ride path; and (b) making contact between each said aligned raft feature on one side of the raft and a flume feature located on a bottom surface of the flume as the raft travels along the ride path, such contact causing the raft to spin about the raft center of rotation.

17. The method of claim 16 wherein the ride path includes a curve and the step of making contact between each said aligned raft feature on one side of the raft and the flume feature is performed at an inside of the curve.

* * * * *

UNITED STATES PATENT AND TRADEMARK OFFICE

CERTIFICATE OF CORRECTION

PATENT NO. : 5,716,282

DATED : February 10, 1998

INVENTOR(S) : Oliver Alan Ring, et al.

It is certified that error appears in the above-identified patent and that said Letters Patent is hereby corrected as shown below:

Column 5, line 2, change "flame" to --flume--

Column 5, line 11, change "claim" to --claims--

Column 5, line 22, change "tubber" to --rubber--.

Signed and Sealed this

Ninth Day of June, 1998

*Attest:*

*Attesting Officer*

BRUCE LEHMAN

*Commissioner of Patents and Trademarks*